US005971300A

United States Patent [19]

Coldren et al.

[11] Patent Number: 5,971,300

[45] Date of Patent: Oct. 26, 1999

[54] FUEL INJECTOR EMPLOYING CENTER FUEL FLOW AND PRESSURE-ASSISTED CHECK CLOSING

[75] Inventors: Dana R. Coldren, Fairbury; Marvin P. Schneider, East Peoria, both of Ill.; Colin T. Timms, Harrow Weald, United Kingdom

[73] Assignees: Caterpillar, Inc., Peoria, Ill.; Lucas Industries Public Limited Company, Solihull, United Kingdom

[21] Appl. No.: 08/964,198

[22] Filed: Nov. 4, 1997

[51] Int. Cl.[6] ..... F02M 37/04

[52] U.S. Cl. ..... 239/533.8; 239/533.3; 239/533.2; 239/88; 239/90; 239/91; 239/92

[58] Field of Search ..... 239/533.8, 533.3, 239/533.2, 88, 90, 91, 92

[56] References Cited

U.S. PATENT DOCUMENTS 4,979,676 12/1990 Hehn ..... 239/533.8 X
5,628,293 5/1997 Gibson et al. ..... 123/446
5,673,853 10/1997 Crofts et al. ..... 239/88

FOREIGN PATENT DOCUMENTS 2 114 658 8/1983 United Kingdom .
2 320 289 6/1998 United Kingdom .

OTHER PUBLICATIONS

U.K. Search Report dated Dec. 10, 1998, Appl. No. GB 9820418.3.

*Primary Examiner*—Andres Kashnikow
*Assistant Examiner*—David Deal
*Attorney, Agent, or Firm*—Marshall, O'Toole, Gerstein, Murray & Borun

[57] ABSTRACT

A fuel injector includes a center tube which conducts fuel flow. A flat-seat poppet valve surrounds a lower portion of the center tube and controls the application of pressurized fuel to first and second check end passages to assist in check closure.

11 Claims, 3 Drawing Sheets

FUEL INJECTOR EMPLOYING CENTER FUEL FLOW AND PRESSURE-ASSISTED CHECK CLOSING

TECHNICAL FIELD

The present invention relates generally to fuel injection apparatus, and more particularly to a fuel injector having one or more components that conduct fuel down the center of the injector.

BACKGROUND ART

Fuel injected engines employ fuel injectors, each of which delivers a metered quantity of fuel to an associated engine cylinder during each engine cycle. Prior fuel injectors were of the mechanically or hydraulically actuated type with either mechanical or hydraulic control of fuel delivery. More recently, electronically controlled fuel injectors have been developed. In the case of an electronic unit injector, fuel is supplied to the injector by a transfer pump. The injector includes a plunger which is movable by a cam-driven rocker arm to compress the fuel delivered by the transfer pump to a high pressure. An electrically operated mechanism either carried outside the injector body or disposed within the injector proper is then actuated to cause fuel delivery to the associated engine cylinder.

In prior fuel injector designs, high pressure fuel is conducted through passages which are located outside of a central recess containing a solenoid which operates a valving mechanism. The passages are located close to the outer surface of the fuel injector and are formed by drilling intersecting holes. After drilling, portions of some of the holes must be filled with plugs. These passages and plugs are subjected to very high fluid pressures, thus requiring careful design and increasing complexity and cost.

In addition to the foregoing, because the high pressure passages are located outside of the solenoid, the size of the solenoid is necessarily limited, thereby limiting the available solenoid force.

Still further, a prior type of fuel injector utilizes a cartridge valve mounted outside of the injector body. This cartridge valve adds significantly to the size and cost of the overall injector.

SUMMARY OF THE INVENTION

A fuel injector includes a high pressure fuel passage which is substantially coincident with the center axis of the injector and further provides pressure-assisted closing of the injector check.

More particularly, in accordance with one aspect of the present invention, a fuel injector includes an injector case defining a central axis, a plunger cavity and a center tube having a fuel passage coincident with the central axis and extending between a first end in fluid communication with the plunger cavity and a second end. First and second check end passages are disposed in fluid communication with first and second ends, respectively, of a check assembly. A valve is disposed in a valve recess and surrounds the second end of the center tube and is movable between an open position wherein the fuel passage is in fluid communication with the valve recess and the first and second check end passages and a closed position wherein the fuel passage is in fluid communication with the first check end passage and is isolated from the valve recess and the second check end passage. An actuator is provided for moving the valve between open and closed positions.

Preferably, the valve comprises a flat-seat poppet valve. Also preferably, the actuator comprises a solenoid which may include an armature surrounding the center tube and coupled to the valve. Still further in accordance with the preferred embodiment, the valve is biased toward the open position by a valve spring.

In accordance with a further aspect of the present invention, a fuel injector includes an injector case defining a central axis, a check assembly having first and second ends and first and second check end passages in fluid communication with the first and second ends of the check assembly, respectively. A central fuel passage is substantially coincident with the central axis for conducting fuel from a first end to a second end of the central fuel passage. A flat-seat poppet valve is disposed in a valve recess and surrounds the second end of the central passage. The poppet valve is movable between an open position wherein the central fuel passage is in fluid communication with the valve recess and the first and second check end passages and a closed position wherein the central fuel passage is in fluid communication with the first check end passage and is isolated from the valve recess and the second check end passage. An actuator is operable in response to an applied waveform to move the flat-seat poppet valve from the open position to the closed position to cause pressurized fuel to be delivered through the first check end passage to the first end of the check assembly to open the check. The actuator is subsequently responsive to allow the flat seat poppet valve to move to the open position when the waveform is removed such that pressurized fuel is delivered from the first end of the check assembly through the first and second check end passages to the second end of the check assembly to quickly close the check.

In accordance with yet another aspect of the present invention, a fuel injector includes an injector case defining a central axis, a plunger passage substantially coincident with the central axis and a check assembly having a lower end and an upper end. First and second check end passages are disposed in fluid communication with the lower and upper ends of the check assembly, respectively. A check spring biases the check downwardly and a center tube is provided having a central passage substantially coincident with the central axis for conducting fuel between first and second ends of the center tube. A flat-seat poppet valve is disposed in a valve recess connected to drain and surrounds the first end of the center tube and is movable between open and closed positions. The valve recess is placed in fluid communication with the plunger passage and the central passage when the flat-seat poppet valve is moved to the open position. The central passage and the plunger are placed in fluid communication with the first check end passage and are isolated from the valve recess and the second check end passage when the flat-seat poppet valve is moved to the closed position. A valve spring biases the flat-seat poppet valve to the open position and a solenoid is provided having a solenoid coil and an armature coupled to the flat-seat poppet valve.

The present invention eliminates high pressure intersecting holes and plugs and further eliminates the cartridge valve found in prior injector designs. Fewer parts and manufacturing operations are required and more space is provided for a larger diameter solenoid so that increased solenoid force can be obtained. In addition, more space can be made available for other components, such as an external wiring connector. Still further, improved hydraulic response is obtained and the blind bore in the barrel of previous designs is eliminated, thereby facilitating production.

BEST MODE FOR CARRYING OUT THE INVENTION

Figure 1:
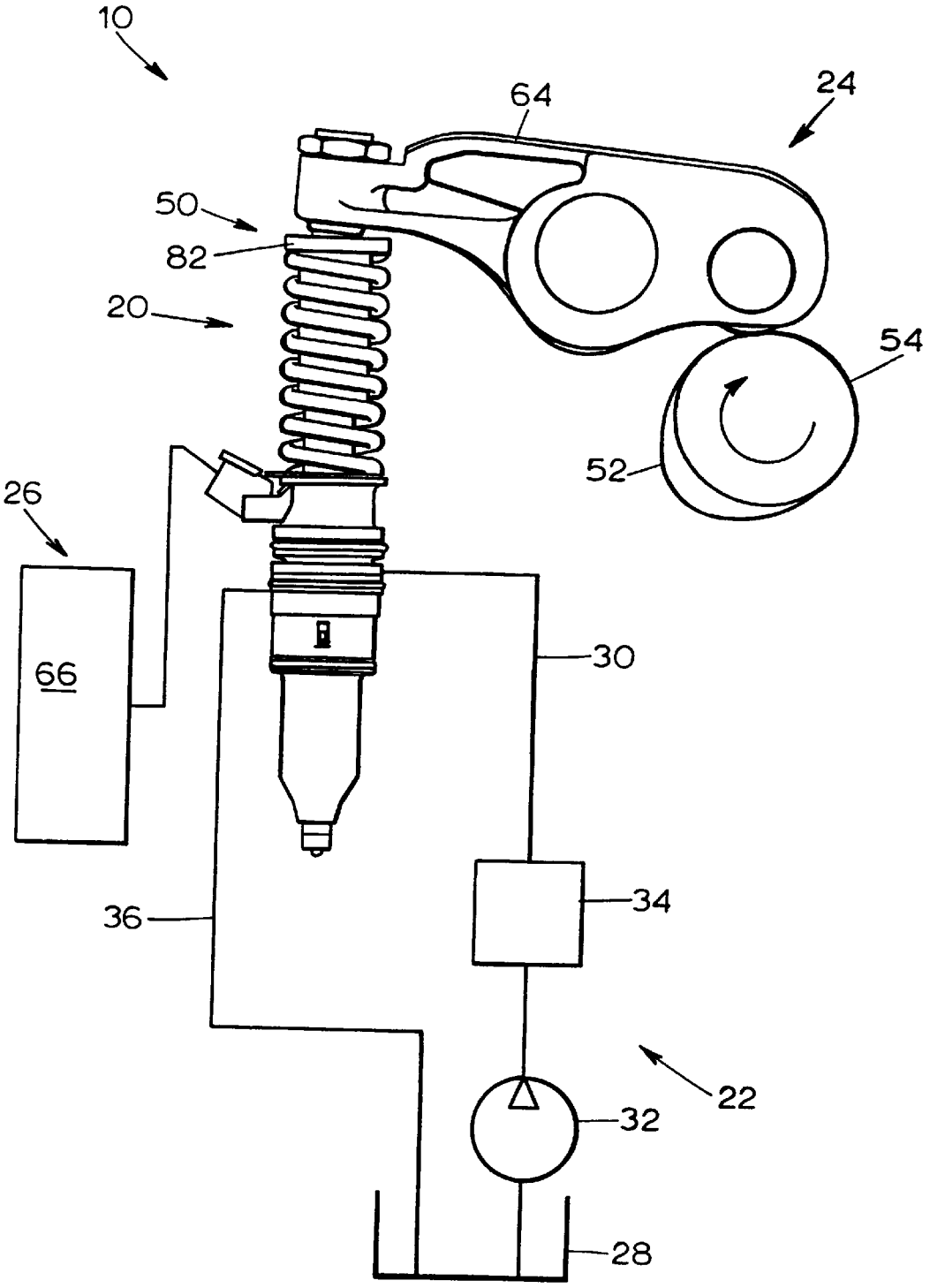
FIG. 1 is an elevational view of a fuel injector incorporating the present invention together with a cam shaft and rocker arm and further illustrating a block diagram of a transfer pump and a drive circuit for controlling the fuel injector.

Referring to FIG. 1, a portion of a fuel system 10 is shown adapted for a direct-injection diesel-cycle reciprocating internal combustion engine. However, it should be understood that the present invention is also applicable to other types of engines, such as rotary engines or modified-cycle engines, and that the engine may contain one or more engine combustion chambers or cylinders. The engine has at least one cylinder head wherein each cylinder head defines one or more separate injector bores, each of which receives an injector 20 according to the present invention.

The fuel system 10 further includes apparatus 22 for supplying fuel to each injector 20, apparatus 24 for causing each injector 20 to pressurize fuel and apparatus 26 for electronically controlling each injector 20.

The fuel supplying apparatus 22 preferably includes a fuel tank 28, a fuel supply passage 30 arranged in fluid communication between the fuel tank 28 and the injector 20, a relatively low pressure fuel transfer pump 32, one or more fuel filters 34 and a fuel drain passage 36 arranged in fluid communication between the injector 20 and the fuel tank 28. If desired, fuel passages may be disposed in the head of the engine in fluid communication with the fuel injector 20 and one or both of the passages 30 and 36.

The apparatus 24 may be any mechanically-actuating device or hydraulically-actuating device. In the embodiment shown a tappet and plunger assembly 50 associated with the injector 20 is mechanically actuated indirectly or directly by a cam lobe 52 of an engine-driven cam shaft 54. The cam lobe 52 drives a pivoting rocker arm assembly 64 which in turn reciprocates the tappet and plunger assembly 50. Alternatively, a push rod (not shown) may be positioned between the cam lobe 52 and the rocker arm assembly 64.

The electronic controlling apparatus 26 preferably includes an electronic control module (ECM) 66 which controls: (1) fuel injection timing; (2) total fuel injection quantity during an injection cycle; (3) the number of separate injection segments during each injection cycle; (4) the time interval(s) between the injection segments; and (5) the fuel quantity delivered during each injection segment of each injection cycle.

Preferably, each injector 20 is a unit injector which includes in a single housing apparatus for both pressurizing fuel to a high level (for example, 207 MPa (30,000 p.s.i.) and injecting the pressurized fuel into an associated cylinder. Although shown as a unitized injector 20, the injector could alternatively be of a modular construction wherein the fuel injection apparatus is separate from the fuel pressurization apparatus.

Figure 2:
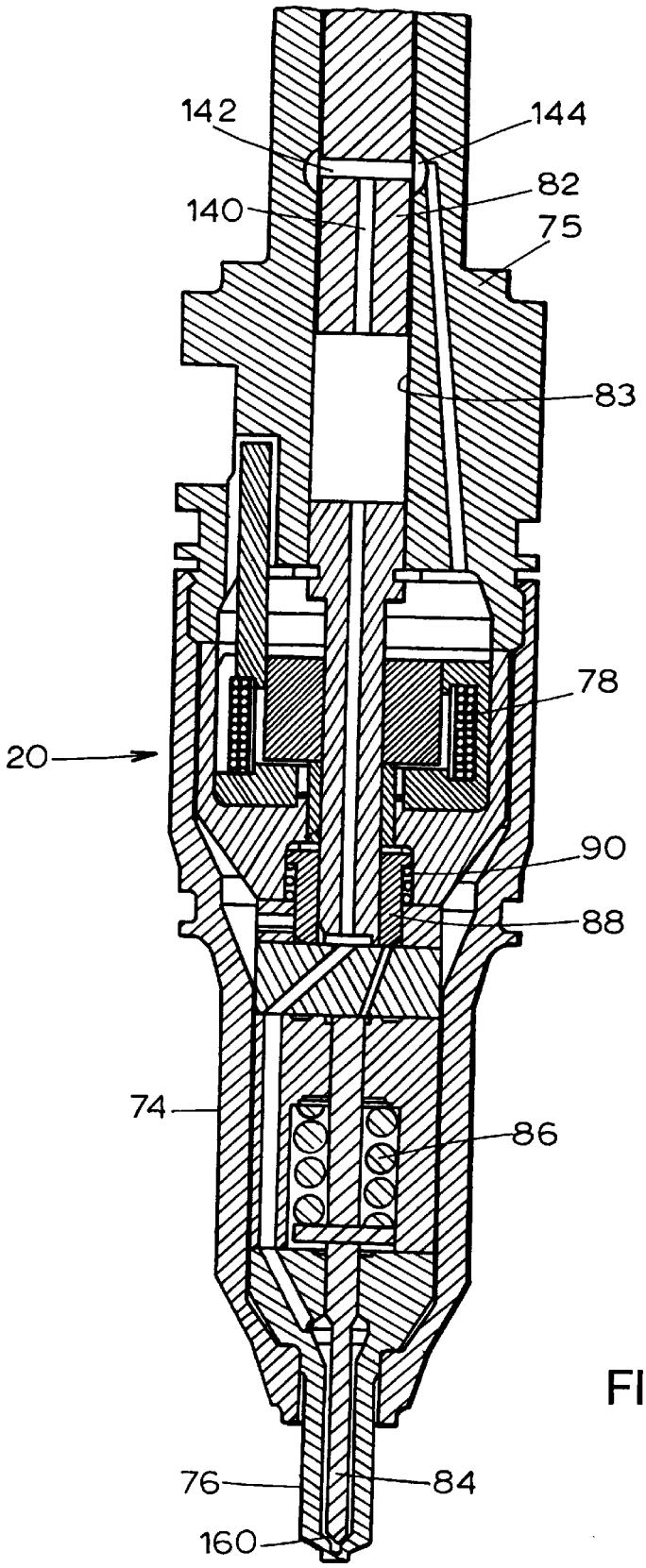
FIG. 2 is a fragmentary sectional view of the fuel injector of FIG. 1.
Figure 3:
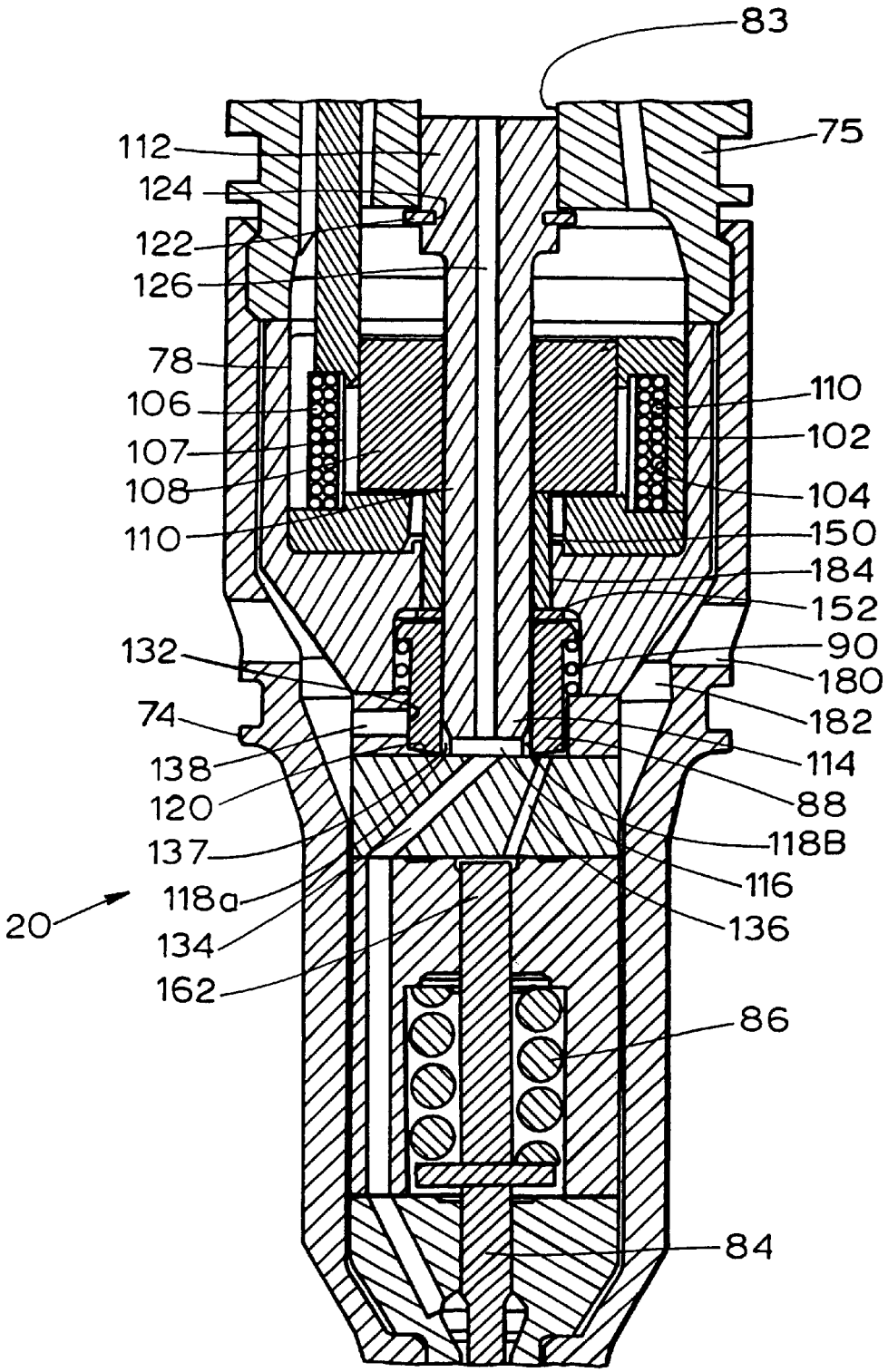
FIG. 3 is an enlarged, fragmentary sectional view of the fuel injector of FIG. 2.

Referring now to FIGS. 2 and 3, the injector 20 includes a case 74, a barrel 75 secured to the case 74, a nozzle portion 76, an electrical actuator 78, a plunger 82 (seen in FIG. 2) disposed in a plunger cavity 83 extending fully through the barrel 75, a check 84 disposed in the nozzle portion 76, a check spring 86 surrounding a check piston 87 which, together with the check 84, forms a check assembly, a flat-seat poppet valve 88 and a valve spring 90.

The electrical actuator 78 comprises a solenoid 100 for controlling the valve 88. The solenoid 100 includes a stator 102 having a recess 104 within which is disposed a solenoid coil 106 wound on a bobbin 107. The solenoid 100 further includes an annular armature 108 which surrounds and is axially movable with respect to a center tube 110. The center tube 110 includes a first or upper end 112 which has a match clearance fit within the plunger cavity 83 and a second or lower end 114 including a pair of downwardly depending legs 116 (only one of which is visible in the FIGS.) which are separated by slots 118*a*, 118*b*. The legs 116 rest on a sealing surface 120 and prevent downward movement of the center tube 110. Upward movement of the center tube 110 is prevented by a snap ring 122 mounted in an annular groove 124. A central fuel passage 126 extends through the entire length of the center tube 110 and is substantially coincident with a central axis of the injector case 74.

The flat seat poppet valve 88 is disposed in a valve recess 132 and surrounds the second end 114 of the center tube 110. The valve 88 is movable between an open or upper position wherein the central fuel passage 126 is in fluid communication with the valve recess 132 and further is in fluid communication with first and second check end passages 134, 136, respectively, and a closed or downward position wherein a sealing knife edge 137 is in engagement with the sealing surface 120. In the closed position, the valve 88 causes the central fuel passage 126 to be in fluid communication solely with the first check end passage 134 and isolates such passages from the valve recess 132 and the second check end passage 136.

The valve recess 132 is in fluid communication with fuel supply and drain through a fuel drain passage 138 and an annular clearance 184.

INDUSTRIAL APPLICABILITY

When the solenoid coil 106 is unenergized, the valve spring 90 forces the flat seat poppet valve 88 upwardly to the open position. Fuel is supplied at transfer pump pressure to the injector through passage 180 to annular space 182, through drain passage 138 to the valve recess 132. Fuel further flows through the slots 118*a*, 118*b* into the central fuel passage 126 and the plunger cavity 83 and through passages 140, 142 to an annular groove 144 (elements 140, 142, 144 are shown in FIG. 2) which is in fluid communication with drain through passages (not shown).

When a suitable current waveform is supplied to the solenoid coil 106, the armature 108 is moved downwardly relative to the stationary tube 110, in turn displacing a drive member 150 and a drive washer 152 and the valve 88 downwardly such that the knife edge 137 of the valve 88 seats against the sealing surface 120. At this point, the first check end passage 134, which is in fluid communication with a lower end 160 of the check 84, is isolated from the valve recess 132 and the drain passage 138. The plunger 82 is thereafter moved downwardly, taking the passages 142 out of fluid communication with the annular groove 144, and permitting fuel in the plunger cavity 83 to be pressurized. This pressurized fuel is conducted through the central fuel passage 126 and the first check end passage 134 to the lower end 160 of the check. At this time, an upper end 162 of the check piston 87 is exposed to drain fluid pressure by the second check end passage 136, the valve recess 132 and the drain passage 138. Eventually, the fluid pressure at the lower check end 160 exceeds the force exerted by the check spring 86 and the check 84 moves upwardly, thus initiating fuel injection.

When injection is to be terminated, the waveform is removed from the solenoid coil 106, thereby permitting the valve spring 90 to move the poppet valve 88 upwardly to the open position. The first check end passage 134 is immediately placed in fluid communication with the second check end passage 136, in turn causing a pulse of pressurized fuel to be applied to the upper end 162 of the check piston 87 which assists in downward movement of the check 84 to the closed position. This spill pulse assisted closing of the check 84 improves the end of injection.

The fuel injector of the present invention eliminates the need for an externally mounted cartridge valve, thereby reducing the cost of the injector body. Further, the use of a center tube 110 having a central fuel passage 126 together with a flat seat poppet valve 88 arranged about the center tube permits the diameter of the solenoid 100 to be maximized and further eliminates high pressure intersecting passages. Still further, only the center tube 110 is aligned by means of a match clearance in the barrel 75, thereby minimizing alignment problems. In addition, the poppet valve 88 is closely located to the second check end passage 136, thereby improving check response for a clean and sharp end of injection. The bore comprising the plunger cavity 83 extends fully through the barrel 75, thereby eliminating the blind bore found in previous designs so that production is facilitated. A significant cost reduction can be realized due to the symmetrical injector body and fewer parts. Poppet mass and high pressure volume are reduced for improved hydraulic response which, together with the improved check response due to the proximity of the passage 136 to the valve 88, allow true split injection capability.

Numerous modifications and alternative embodiments of the present invention will be apparent to those skilled in the art in view of the foregoing description. Accordingly, this description is to be construed as illustrative only and is for the purpose teaching those skilled in the art the best mode of carrying out the invention. The details of the structure and/or function may be varied substantially without departing from the spirit of the invention, and the exclusive use of all modifications which come within the scope of the appended claims is reserved.

We claim:

1. A fuel injector, comprising:

an injector case defining a central axis;

a plunger cavity;

a center tube having a fuel passage coincident with the central axis and extending between a first end in fluid communication with the plunger cavity and a second end;

first and second check end passages in fluid communication with first and second ends, respectively, of a check assembly;

a valve disposed in a valve recess and surrounding the second end of the center tube and movable between an open position wherein the fuel passage is in fluid communication with the valve recess and the first and second check end passages and a closed position wherein the fuel passage is in fluid communication with the first check end passage and is isolated from the valve recess and the second check end passage; and an actuator for moving the valve between the open and closed positions.

2. The fuel injector of claim 1, wherein the valve comprises a flat-seat poppet valve.

3. The fuel injector of claim 1, wherein the actuator comprises a solenoid.

4. The fuel injector of claim 3, wherein the solenoid includes an armature surrounding the center tube and coupled to the valve.

5. The fuel injector of claim 1, wherein the valve is biased toward the open position by a valve spring.

6. The fuel injector of claim 1, wherein the plunger cavity comprises a bore extending fully through a barrel and wherein the center tube is disposed in the plunger cavity.

7. A fuel injector, comprising:

an injector case defining a central axis;

a check assembly having first and second ends;

first and second check end passages in fluid communication with the first and second ends of the check assembly, respectively;

a central fuel passage substantially coincident with the central axis for conducting fuel from a first end to a second end of the central fuel passage;

a flat-seat poppet valve disposed in a valve recess and surrounding the second end of the central passage and movable between an open position wherein the central fuel passage is in fluid communication with the valve recess and the first and second check end passages and a closed position wherein the central fuel passage is in fluid communication with the first check end passage and is isolated from the valve recess and the second check end passage; and an actuator operable in response to an applied waveform to move the flat-seat poppet valve from the open position to the closed position to cause pressurized fuel to be delivered through the first check end passage to the first end of the check assembly to open the check and subsequently responsive to allow the flat-seat poppet valve to move to the open position when the waveform is removed such that pressurized fuel is delivered from the first end of the check assembly through the first and second check end passages to the second end of the check assembly to quickly close the check.

8. The fuel injector of claim 7, wherein the actuator comprises a solenoid.

9. The fuel injector of claim 7, wherein the solenoid includes an armature surrounding the central fuel passage and coupled to the flat-seat poppet valve.

10. The fuel injector of claim 8, wherein the flat-seat poppet valve is biased toward the open position by a valve spring.

11. A fuel injector, comprising:

an injector case defining a central axis;

a plunger passage substantially coincident with the central axis;

a check assembly having a lower end and an upper end;

first and second check end passages in fluid communication with the lower and upper ends of the check assembly, respectively;

a check spring biasing the check downwardly;

a center tube having a central passage substantially coincident with the central axis for conducting fuel between first and second ends of the center tube;

a flat-seat poppet valve disposed in a valve recess connected to drain and surrounding the second end of the center tube and movable between open and closed positions wherein the valve recess is placed in fluid communication with the plunger passage and the central passage when the flat-seat poppet valve is moved to the open position and wherein the central passage and the plunger passage are placed in fluid communication with the first check end passage and isolated from the valve recess and the second check end passage when the flat-seat poppet valve is moved to the closed position;

a valve spring biasing the flat-seat poppet valve to the open position; and a solenoid having a solenoid coil and an armature coupled to the flat-seat poppet valve.

* * * * *